US008933973B2

(12) United States Patent
Mizukoshi et al.

(10) Patent No.: US 8,933,973 B2
(45) Date of Patent: Jan. 13, 2015

(54) DISPLAY DEVICE

(75) Inventors: Seiichi Mizukoshi, Chigasaki (JP); Makoto Kohno, Yokohama (JP); Nobuyki Mori, Asaka (JP)

(73) Assignee: Global OLED Technology LLC, Herndon, VA (US)

( * ) Notice: Subject to any disclaimer, the term of this patent is extended or adjusted under 35 U.S.C. 154(b) by 410 days.

(21) Appl. No.: 13/387,649

(22) PCT Filed: Aug. 3, 2010

(86) PCT No.: PCT/US2010/044198

§ 371 (c)(1),
(2), (4) Date: May 8, 2012

(87) PCT Pub. No.: WO2011/017290

PCT Pub. Date: Feb. 10, 2011

(65) Prior Publication Data

US 2012/0268501 A1 Oct. 25, 2012

(30) Foreign Application Priority Data

Aug. 7, 2009 (JP) ..... 2009-184373

(51) Int. Cl.
*G09G 5/10* (2006.01)
*G09G 3/32* (2006.01)

(52) U.S. Cl.
CPC ..... *G09G 3/3233* (2013.01); *G09G 2300/0866* (2013.01); *G09G 2310/0256* (2013.01); *G09G 2320/043* (2013.01); *G09G 2320/103* (2013.01); *G09G 2360/16* (2013.01)
USPC ..... 345/690; 345/84; 345/214

(58) Field of Classification Search
CPC ..... G09G 3/3233; G09G 5/10; G09G 2300/0866; G09G 2310/0256; G09G 2320/103; G09G 2360/16
USPC ..... 345/58, 76, 84, 89, 92, 214, 690; 349/61
See application file for complete search history.

(56) References Cited

U.S. PATENT DOCUMENTS

| | | | | |
|---|---|---|---|---|
| 5,841,412 | A | 11/1998 | Ebihara | |
| 6,700,571 | B2 | 3/2004 | Nakatani et al. | |
| 6,856,351 | B1 * | 2/2005 | Weisfield | 348/310 |
| 2002/0036292 | A1 * | 3/2002 | Yamashita | 257/72 |
| 2006/0187154 | A1 | 8/2006 | Tsuchida et al. | |

(Continued)

FOREIGN PATENT DOCUMENTS

| | | | |
|---|---|---|---|
| CN | 1581254 | A | 2/2005 |
| CN | 1725282 | A | 1/2006 |

(Continued)

*Primary Examiner* — Joe H Cheng
(74) *Attorney, Agent, or Firm* — Global OLED Technology LLC

(57) ABSTRACT

There is provided a display device in which disadvantageous effects due to unnecessary operations of an image lag alleviating function are minimized. In a display device of active matrix type, for each of the pixels arranged in a matrix, a current-driven emissive element is provided, and the current of the emissive element is controlled using a drive TFT so as to perform display. While a black display period during which an opposite bias voltage is applied between the gate electrode and the source electrode of the drive TFT is inserted in order to alleviate image lag, this insertion is performed only when a predetermined condition is satisfied, and is performed for a certain duration according to a command by a microcomputer (10).

4 Claims, 22 Drawing Sheets

(56) References Cited

U.S. PATENT DOCUMENTS

| | | | | |
|---|---|---|---|---|
| 2007/0080905 | A1 | 4/2007 | Takahara | |
| 2007/0126757 | A1 | 6/2007 | Itoh et al. | |
| 2007/0279374 | A1* | 12/2007 | Kimura et al. | 345/102 |
| 2007/0296672 | A1 | 12/2007 | Kim et al. | |
| 2008/0284719 | A1 | 11/2008 | Yoshida | |
| 2009/0026452 | A1* | 1/2009 | Miyaguchi et al. | 257/59 |
| 2009/0040242 | A1* | 2/2009 | Tomizawa et al. | 345/690 |
| 2009/0128636 | A1* | 5/2009 | Wakagi et al. | 348/208.1 |
| 2009/0152664 | A1 | 6/2009 | Klem et al. | |
| 2009/0174689 | A1* | 7/2009 | Ishihara | 345/204 |
| 2009/0268083 | A1* | 10/2009 | Arishima et al. | 348/362 |
| 2010/0134479 | A1 | 6/2010 | Takasugi et al. | |

FOREIGN PATENT DOCUMENTS

| | | |
|---|---|---|
| JP | 2005-121875 | 5/2005 |
| JP | 2006-251455 A | 9/2006 |
| JP | 2007114286 | 5/2007 |
| JP | 2007515687 | 6/2007 |
| JP | 2007279738 | 10/2007 |
| JP | 2008-3542 A | 1/2008 |
| WO | 2006/070833 | 7/2006 |
| WO | 2008/136229 | 11/2008 |

* cited by examiner

DISPLAY DEVICE

This application is a National Stage Entry of International Application No. PCT/US2010/044198, filed Aug. 3, 2010, and claims the benefit of Japanese Application No. 2009-184373, filed on Aug. 7, 2009, which is hereby incorporated by reference for all purposes as if fully set forth herein.

BACKGROUND

1. Technical Field

The present invention relates to an active matrix type display device in which a current-driven emissive element is provided in each of pixels arranged in a matrix and the current of the emissive element is controlled using a drive TFT to perform display.

2. Related Art

FIG. 1 shows a configuration of a circuit for one pixel (pixel circuit) in a basic active type organic EL display device. A gate line (Gate) extending in the horizontal direction is set to HIGH level so as to turn on a selection TFT 1. In this state, an image data signal (also referred to as "data voltage") having a voltage in accordance with a display brightness is supplied to a data line (Data) extending in the vertical direction. The image data signal is thereby accumulated in a storage capacitor C provided between the gate and source of a drive TFT 2. As a result of this, the drive TFT (in this example, P-type TFT) 2 having the source connected to a power supply PVdd supplies a drive current in accordance with the data signal to an organic EL element 3 connected to the drain of the drive TFT 2. Accordingly, the organic EL element 3 emits light in accordance with the data signal.

FIG. 2 shows an example configuration of a display panel and input signals. In FIG. 2, the image data signal, horizontal synchronization signal (HD), pixel clock, and other drive signals are supplied to a source driver 4. The image data signal is transmitted in synchronization with the pixel clock to the source driver 4. In the source driver 4, when the image data signal for pixels of one horizontal line is taken in, that image data signal is retained in a latch circuit provided therein, collectively subjected to D-A conversion, and then supplied to the data lines of the corresponding columns. Further, the horizontal synchronization signal (HD), other drive signals, and vertical synchronization signal (VD) are supplied to a gate driver 5. The gate driver 5 sequentially turns on the gate lines (Gate) provided along each row extending in the horizontal direction, to perform control such that the image data signal is supplied to the pixels in the corresponding rows. Each of the pixels 6 arranged in the matrix includes the pixel circuit shown in FIG. 1.

Using an arrangement as described above, the image data signal (data voltage) is sequentially written into the respective pixels in units of a horizontal line, and a display in accordance with the written image data signal is performed in each pixel, thereby, as an overall panel, achieving a screen display.

Here, the amount of light emission and the current of the organic EL element 3 have a substantially proportional relationship. Typically, between the gate of the drive TFT 2 and PVdd, a voltage (Vth) that causes a drain current to start to flow near the image black level is applied. Further, the amplitude of the image signal is set to an amplitude that attains a predetermined brightness near the white level.

FIG. 3 shows the relationship of current CV (corresponding to brightness) that flows through the organic EL element with respect to the signal voltage input to the drive TFT (the voltage of the data line Data). By setting the data signal such that Vb is applied as the black level voltage and Vw is applied as the white level voltage, suitable gradation control can be performed in the organic EL element.

In an active matrix type organic EL display device, there exists the problem of image lag being generated due to a hysteresis characteristic of the drive TFT. This problem can be clearly perceived particularly in a case in which first a white window is displayed on a gray background and then the entire screen is switched to display a gray image. In this case, as shown in FIG. 4, the portion in which the white window was displayed until just a moment before becomes slightly darker than other portions, and it may take several seconds to several tens of seconds until the brightness level becomes the same as the other portions. This problem is caused by the phenomenon that, even when the drive TFT of a certain pixel is driven by the same data voltage, the drive current value varies depending on the current that was made to flow several seconds before. It is considered that this phenomenon occurs because the carriers (holes) that flow through the drive TFT become trapped within the gate insulation film, thereby changing the Vth of the drive TFT. In terms of visual perception, this problem is most noticeable when a change is made from a high brightness to a brightness of an intermediate tone. On the other hand, when a change is made from a low brightness to an intermediate-tone brightness or to a high brightness, the problem is not very noticeable. The degree of image lag also depends on the duration of image display in the immediately preceding period. The image lag becomes more noticeable when this duration is longer.

It has been known that the carriers (holes) within the gate insulation film can be eliminated by applying between the gate and source of the drive TFT an opposite bias voltage, i.e., a voltage higher than the PVdd connected to the source. The effect of the opposite bias voltage becomes greater when the opposite bias voltage is higher and is applied for a longer duration. This opposite bias voltage is often applied in each frame for a plurality of line periods before the pixel data are updated.

For example, as shown in FIG. 5, a transistor 7 is added to the pixel circuit. The transistor 7 is of n-channel type, and has a gate connected to a control line CTL, a drain connected to an opposite biasing power supply Va, and a source connected to the gate of the drive TFT 2. In this pixel circuit, by periodically setting the CTL line to HIGH level, Va having a voltage higher than the PVdd voltage can be applied to the gate of the drive TFT 2.

As shown in FIG. 6, a CTL signal supplied to the CTL line is generated in a lights-off control circuit 8, and is sequentially set to ON ("Hi") line by line, similarly to the Gate signal. FIG. 7 shows the timing of writing data for line m and line m+1. Until t1, in pixel (m, n) located in the mth row and nth column, the pixel data that was written during the previous frame is retained in the storage capacitor C, and a pixel current in accordance with that voltage flows in the pixel. When Va is written in the storage capacitor C during t1-t2, the opposite bias voltage is applied between the gate and source of the drive TFT 2, such that the drain current becomes zero. During t3-t4, new pixel data is written in, and a pixel current flows again.

PRIOR ART DOCUMENTS

Patent Document 1: JP 2006-251455 A

Patent Document 2: JP 2008-3542 A

As described above, in an active matrix type organic EL display device, there exists the problem of occurrence of image lag in a portion of the display panel due to the hysteresis characteristic of the drive TFT. As a measure addressing this problem, a transistor is added to the pixel, and an opposite bias voltage is periodically applied between the gate and source of the drive TFT.

However, during the period in which the opposite bias voltage is applied, the pixel is turned off. Accordingly, at time t4 of FIG. 7 within a certain frame, the display state becomes as shown in FIG. 8, with a black band being generated in a portion of the screen. This band moves down line by line, and, after the duration of one frame period, the band returns to the original position after making a full round. Although the black band moves at a high speed and thus is not easily detected visually, this black band may be detected in cases such as when the line of sight is moved.

Moreover, the average brightness of the display becomes reduced to a value obtained by multiplying (lights-on period within one frame/one frame period) to the brightness obtained when the light remains turned on during the entire period. For this reason, in order to maintain the average brightness, the brightness of each pixel must be increased by multiplying (one frame period/lights-on period within one frame) compared to when the image lag alleviating function is not used. Because an organic EL element generally degrades in an accelerated manner with respect to emitted brightness, even when the average brightness is maintained at the same level, the life of the organic EL element becomes shorter when the image lag alleviating function is used.

SUMMARY

The present invention provides an active matrix type display device in which a current-driven emissive element is provided in each of pixels arranged in a matrix and a current of the emissive element is controlled using a drive TFT so as to perform display. The display device includes means for alleviating image lag by periodically applying an opposite bias voltage between a gate electrode and a source electrode of the drive TFT. The means for alleviating image lag operates for a certain duration when a predetermined condition is satisfied.

Preferably, the time when the predetermined condition is satisfied is when a command indicating that a screen display has switched is received from a controller.

Preferably, the display device further includes motion detection means for detecting a motion of an input image, and the time when the predetermined condition is satisfied is when the motion detection means detects the motion.

Preferably, the display device further includes uniform portion determination means for determining whether or not an input image includes a uniform portion, and the time when the predetermined condition is satisfied is when the uniform portion determination means determines a uniform portion.

Preferably, the uniform portion determination means includes means for determining whether or not the input image includes a uniform portion having an intermediate tone, and the time when the predetermined condition is satisfied is when the uniform portion determination means determines a uniform portion having an intermediate tone.

Preferably, the display device further includes motion detection means for detecting a motion of an input image and uniform portion determination means for determining whether or not an input image includes a uniform portion, and the time when the predetermined condition is satisfied is when the motion detection means detects the motion and also the uniform portion determination means determines a uniform portion.

Preferably, the uniform portion determination means includes means for determining whether or not the input image includes a uniform portion having an intermediate tone, and the time when the predetermined condition is satisfied is when the uniform portion determination means determines a uniform portion having an intermediate tone.

According to the present invention, the period during which the image lag alleviation is carried out is limited to a period during which a predetermined condition is satisfied. Accordingly, it is possible to prevent the image lag alleviation from being carried out during unnecessary periods.

DETAILED DESCRIPTION

Figure 1:
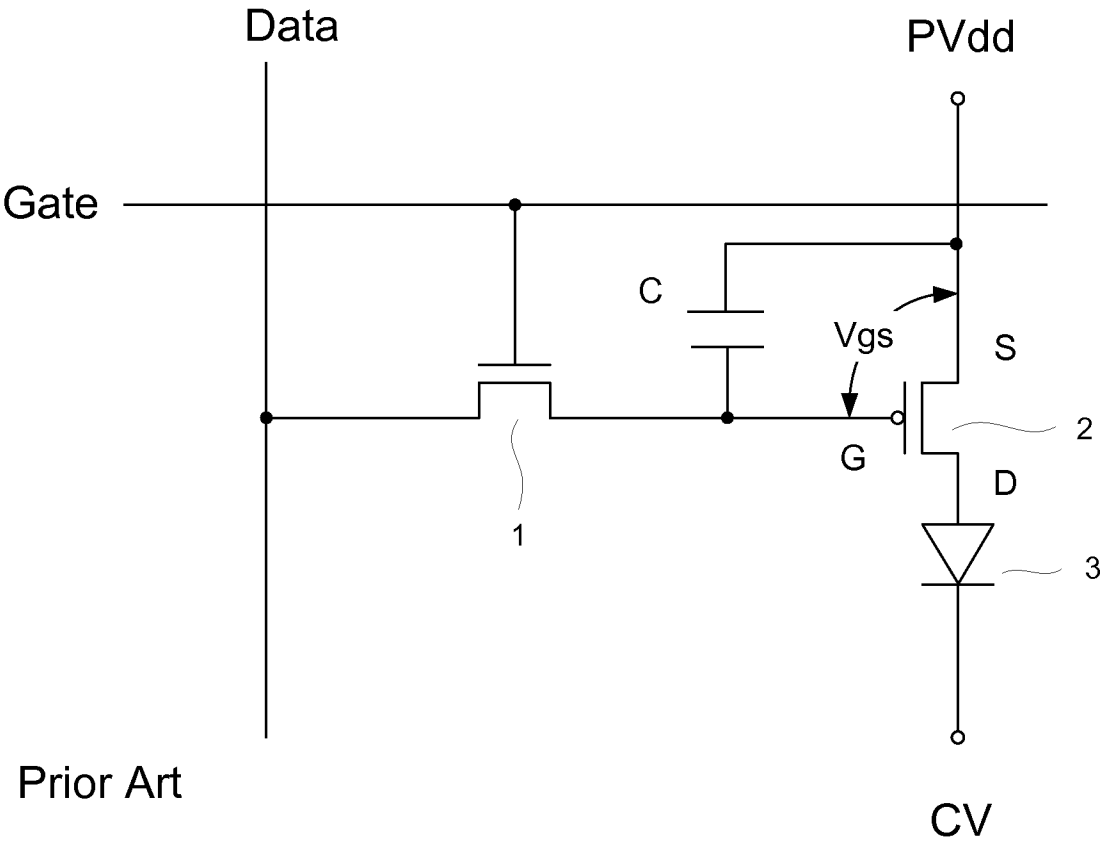
FIG. 1 Prior Art
FIG. 1 is a diagram showing an example configuration of a pixel circuit.

The embodiments of the present invention will be described below referring to the drawings.

Figure 9:
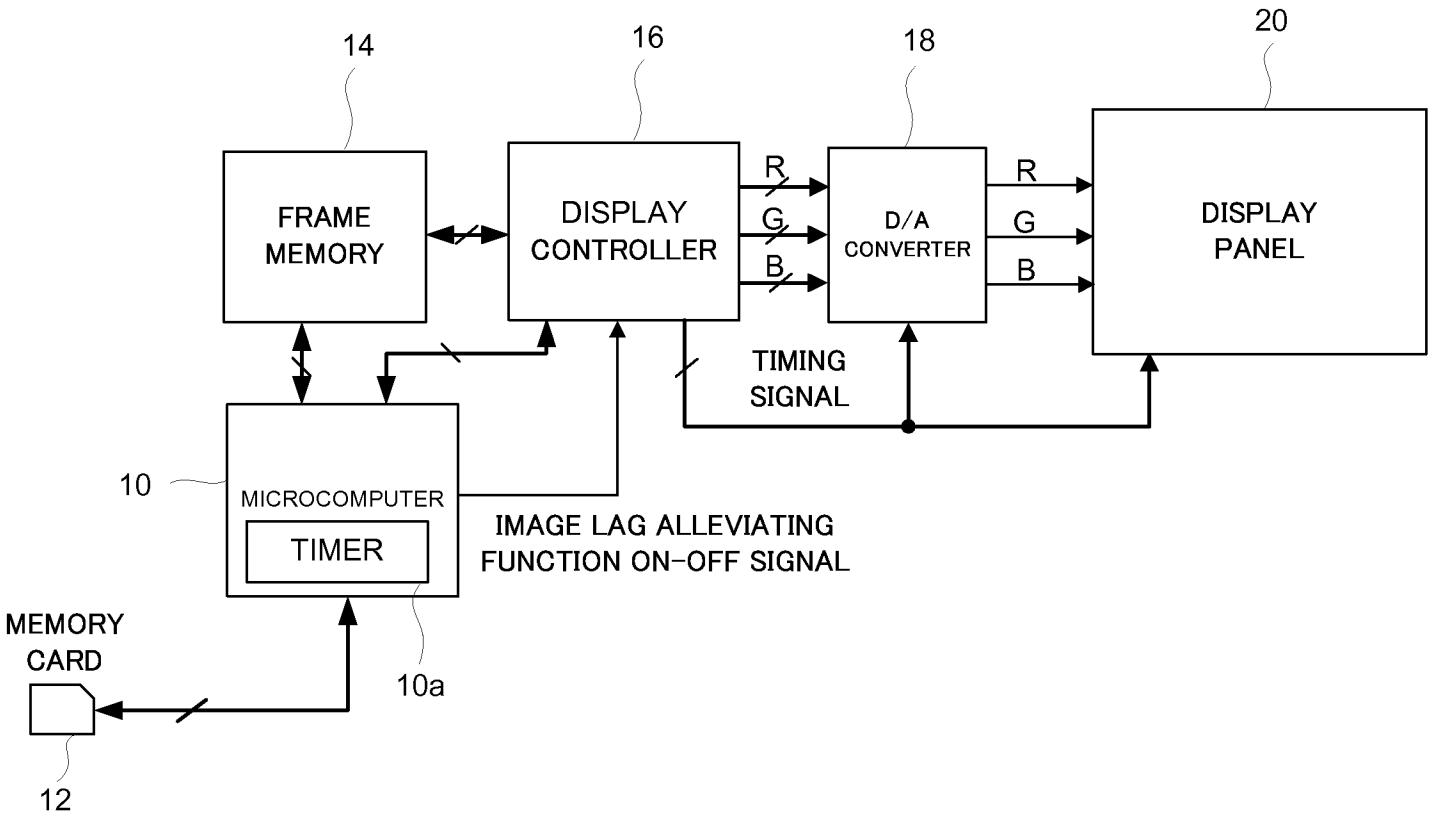
FIG. 9 Prior Art
FIG. 9 is a block diagram showing an example display device according to an embodiment of the present invention.

FIG. 9 is a block diagram showing an example display device according to an embodiment of the present invention. This example display device is employed as a digital photo frame.

A memory card 12 can be inserted into a microcomputer 10. The microcomputer 10 reads a still image file recorded on the memory card 12 and expands the file into a frame memory 14 by performing decompression and the like. The expanded image data are read by a display controller 16 separately for R, G, and B, and are supplied to a D-A converter 18. The RGB signals converted into analog signals in the D-A converter 18 are supplied to a display 20 to display an image thereon.

As a typical function of a photo frame, there is a mode called "slide show". In this mode, different images are sequentially read from the card and displayed in unit periods of several seconds to several tens of seconds. On the display 20, an image lag due to the above-described TFT hysteresis may occur immediately after an image is switched to another image.

According to the present embodiment, the microcomputer 10 turns on the image lag alleviating function at the timing of the switching of the image, and turns off this function after a certain period, such as after two seconds. Specifically, in accordance with a preset program, the microcomputer 10 reads out the image data within the memory card 12 in a predetermined order, executes decompression processing and the like, and then writes the expanded image data into the frame memory 14, thereby switching the image data to be read out from the frame memory 14. At the timing of the writing of the image data into the frame memory 14, the microcomputer 10 sets an image lag alleviating function ON-OFF signal to ON. More specifically, the microcomputer 10 has incorporated therein a timer 10*a*. For the duration of two seconds from the timing at which the image is switched, the microcomputer 10 sets the image lag alleviating function ON-OFF signal to ON, and supplies this signal to the display controller 16.

As a result, when the screen switching (updating) period of the slide show is longer than two seconds, the image lag alleviating function operates intermittently. In cases where the image updating period is longer, the time during which the image lag alleviating function is turned off becomes longer, such that the present invention serves more effectively.

Figure 10:
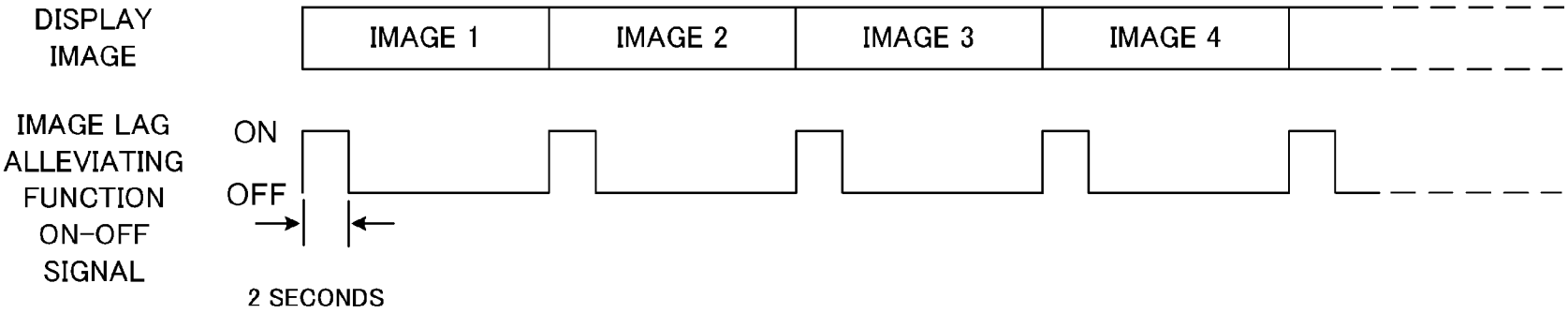
FIG. 10 Prior Art
FIG. 10 is a timing chart showing an example display operation.

FIG. 10 shows an example timing chart. As shown, when the display image is sequentially switched to image 1, image 2, and so on, the image lag alleviating function ON-OFF signal is set to ON for the limited duration of two seconds from the timing of the switching. During other times, the image lag alleviating function ON-OFF signal is set to OFF. Accordingly, the period during which the amount of current supplied to the organic EL element must be increased can be limited to a short duration.

In image display devices such as digital photo frames, as well as in other devices provided with display elements such as digital cameras, there are many cases in which a menu screen is used to perform selection of modes and display images. In these cases, icons including high-brightness portions are often displayed on a background of an intermediate tone, and when no measure for alleviating image lag is implemented, at the point when those icons are made to disappear from the screen, image lag occurring at those screen portions may become highly noticeable.

As the microcomputer 10 which controls the device is aware of the state of switching of the menu screen and the display content, it is also preferable to turn on the image lag alleviating function for a certain duration at the timing of the switching or in accordance with changes in the display content.

Figure 11A:
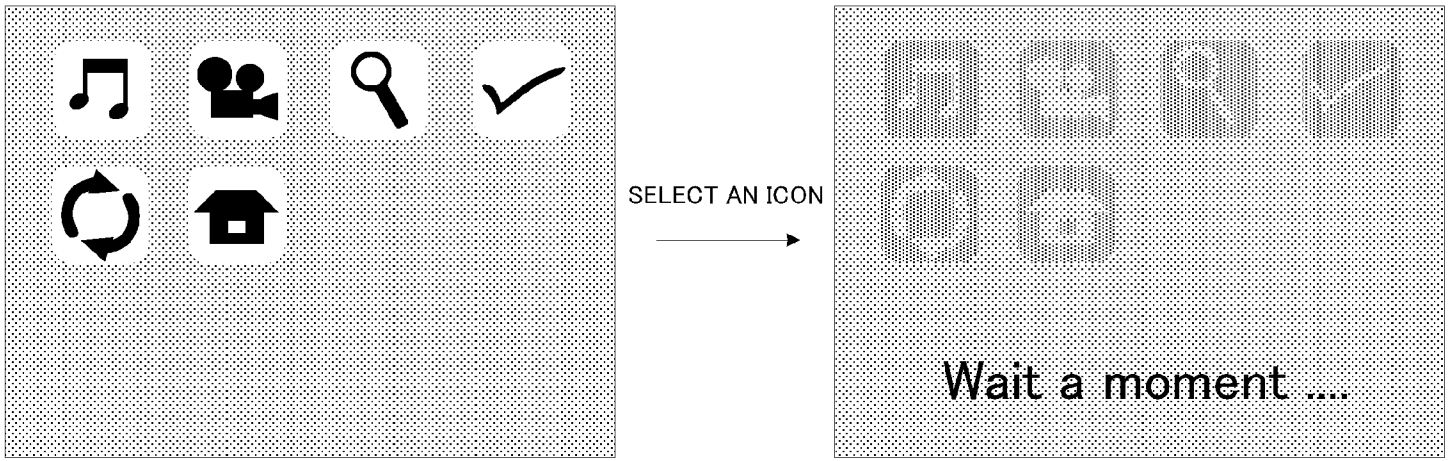
FIG. 11A is a diagram showing a case in which, after an icon is selected in a menu screen, a background of an intermediate tone is displayed on almost the entire screen.
Figure 11B:
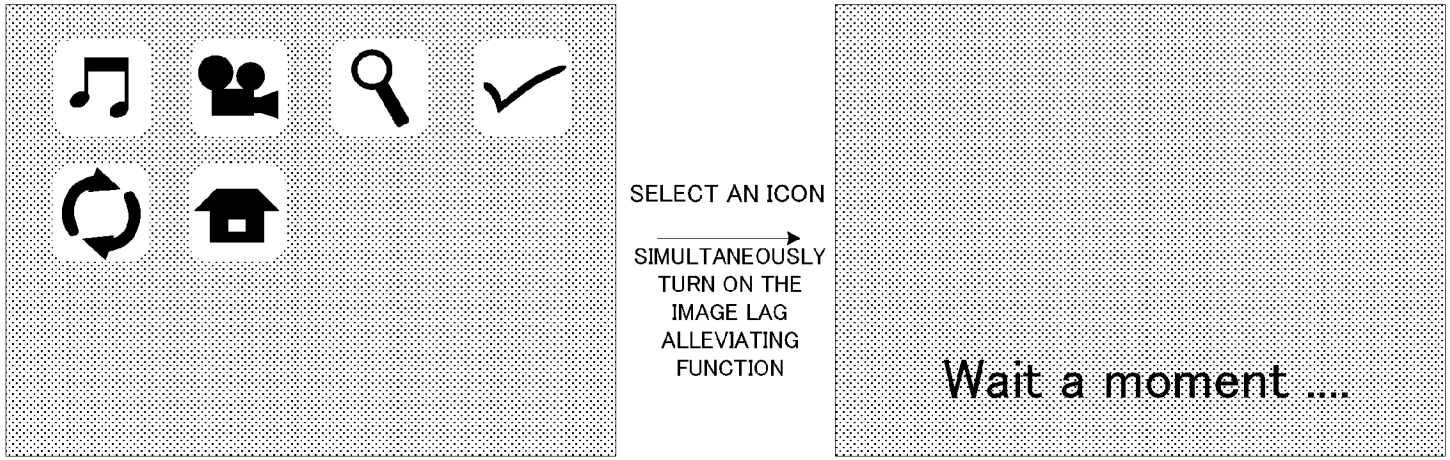
FIG. 11B is a diagram showing an example state in which, at the point of selection of an icon, the image lag alleviating function is turned on for a certain period.

FIG. 11A shows an example case in which, after an icon is selected from a menu screen, almost the entire screen displays a background of an intermediate tone, and image lag of the icons can be seen. By turning on the image lag alleviating function for a certain duration at the timing of icon selection, the image lag can be made practically unnoticeable, as shown in FIG. 11B.

An image lag phenomenon tends to be more noticeable when a design uniformly colored with an intermediate tone is displayed. Accordingly, it is also preferable to analyze, frame by frame, whether or not such a design portion is included in the image data to be input, and to turn on the image lag alleviating function only when such a design portion is included.

Figure 12:
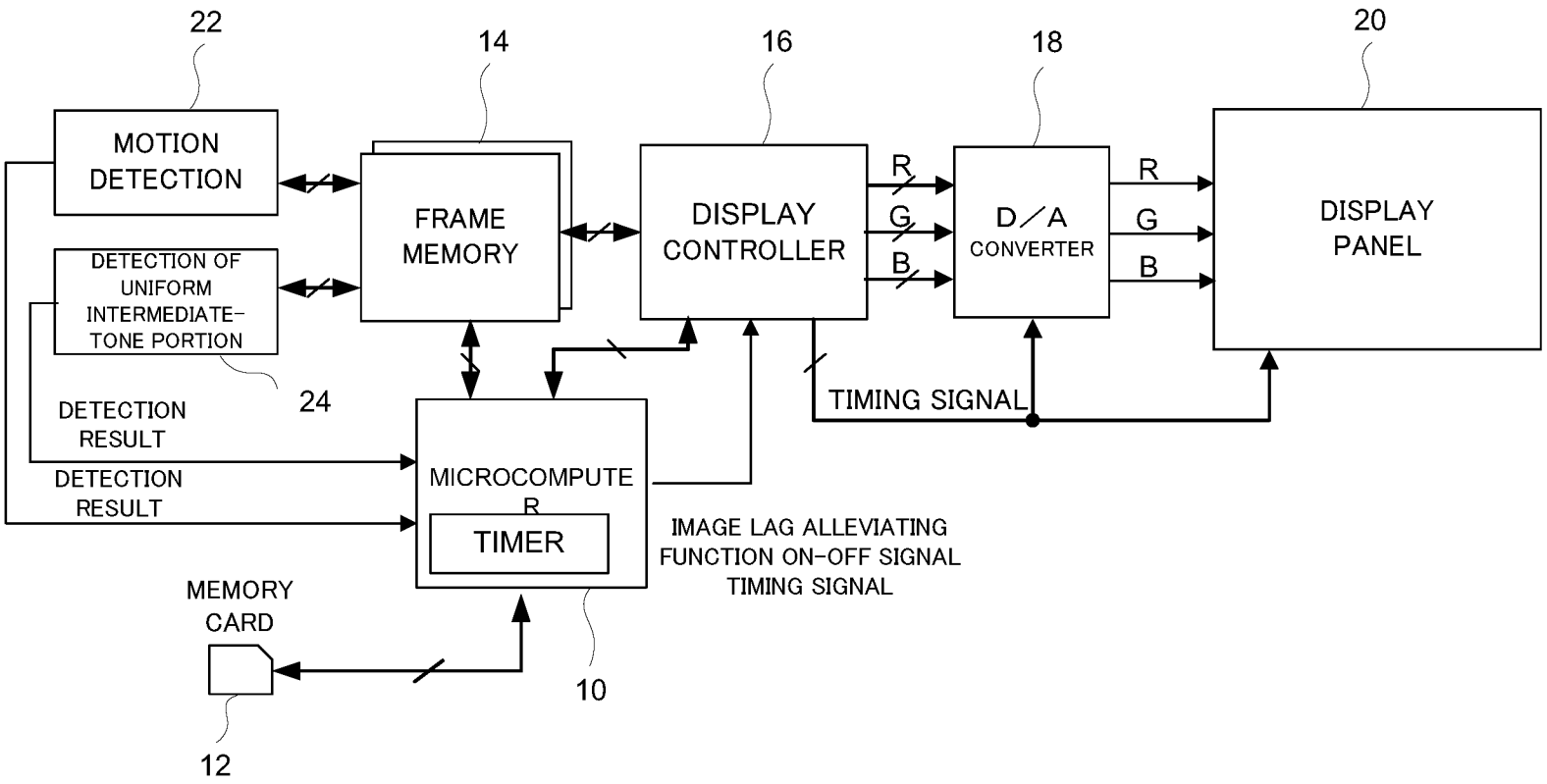
FIG. 12 is a block diagram showing an example configuration in which the function of motion detection and the function of determining a uniform intermediate-tone portion are added to a photo frame.

FIG. 12 is a diagram showing a configuration in which the above-described functions are added to a photo frame that is also capable of reproducing moving image files. As shown, a motion detector 22 is connected to the frame memory 14. The motion detector 22 detects a motion based on comparisons between images of a plurality of frames. Accordingly, in this example, the frame memory 14 stores images of at least two frames. The frame memory 14 also has connected thereto a uniform intermediate-tone portion detector 24. The uniform intermediate-tone portion detector 24 detects whether or not an image includes a predetermined area of uniform intermediate-tone portion.

The detected results of the motion detector 22 and the uniform intermediate-tone portion detector 24 are supplied to the microcomputer 10. Then, based on results of judgment, the microcomputer 10 controls whether or not to turn on the image lag alleviating function.

Figure 13:
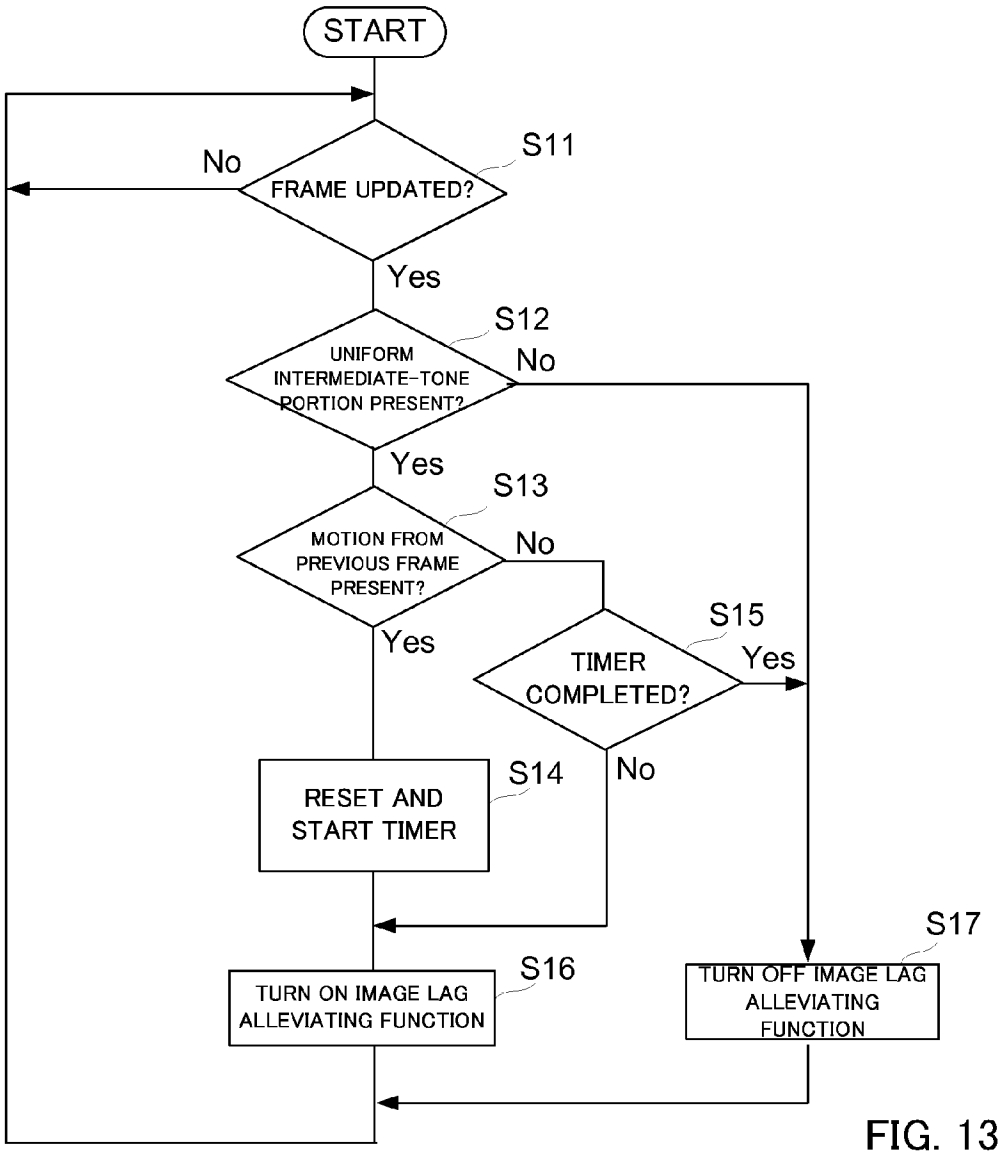
FIG. 13 is a flowchart showing an example control of the image lag alleviating function.

For example, the operation of the image lag alleviating function is controlled according to the flowchart shown in FIG. 13. First, it is determined whether or not the frame is updated (S11), and, when updated, it is determined whether or not a uniform intermediate-tone portion is present (S12). For example, when pixels having brightness within the intermediate tone range and having substantially identical brightness are present within a predetermined region (area), it is determined that a uniform intermediate-tone portion is present. When this determination result is YES, it is next determined whether or not a motion is present based on a comparison between the images of the previous frame and the current frame (S13). When a motion is present, the timer is reset and started (S14). On the other hand, when no motion is present, it is determined whether or not the timer is terminated (S15), and, when not terminated, the image lag alleviating function is turned on (S16) and the process returns to S11. Further, when it is determined NO in S12 and when it is determined YES in S15, the image lag alleviating function is turned off (S17) and the process returns to S11.

As described above, it is first determined whether or not a uniform intermediate-tone portion is present. When present, the motion detector detects a difference from the previous frame, and when the difference is present, the image lag alleviating function is turned on. Although the image lag alleviating function is controlled to be turned off when the timer reaches a preset time (such as two seconds), if the above-noted conditions are satisfied again in the meantime, the timer is reset to continue with the ON state.

Next described below is an example method of determining whether or not a uniform intermediate-tone portion is present. Here, a VGA panel having 640×480 pixels is referred to for example. In a color display, one pixel is typically composed of three dots of R, G, and B. In such a display, the method described below may be applied separately to each of the color signals, and when a uniform intermediate-tone portion is detected in any one of the colors, it may be determined that the image includes a uniform intermediate-tone portion.

Figure 14:
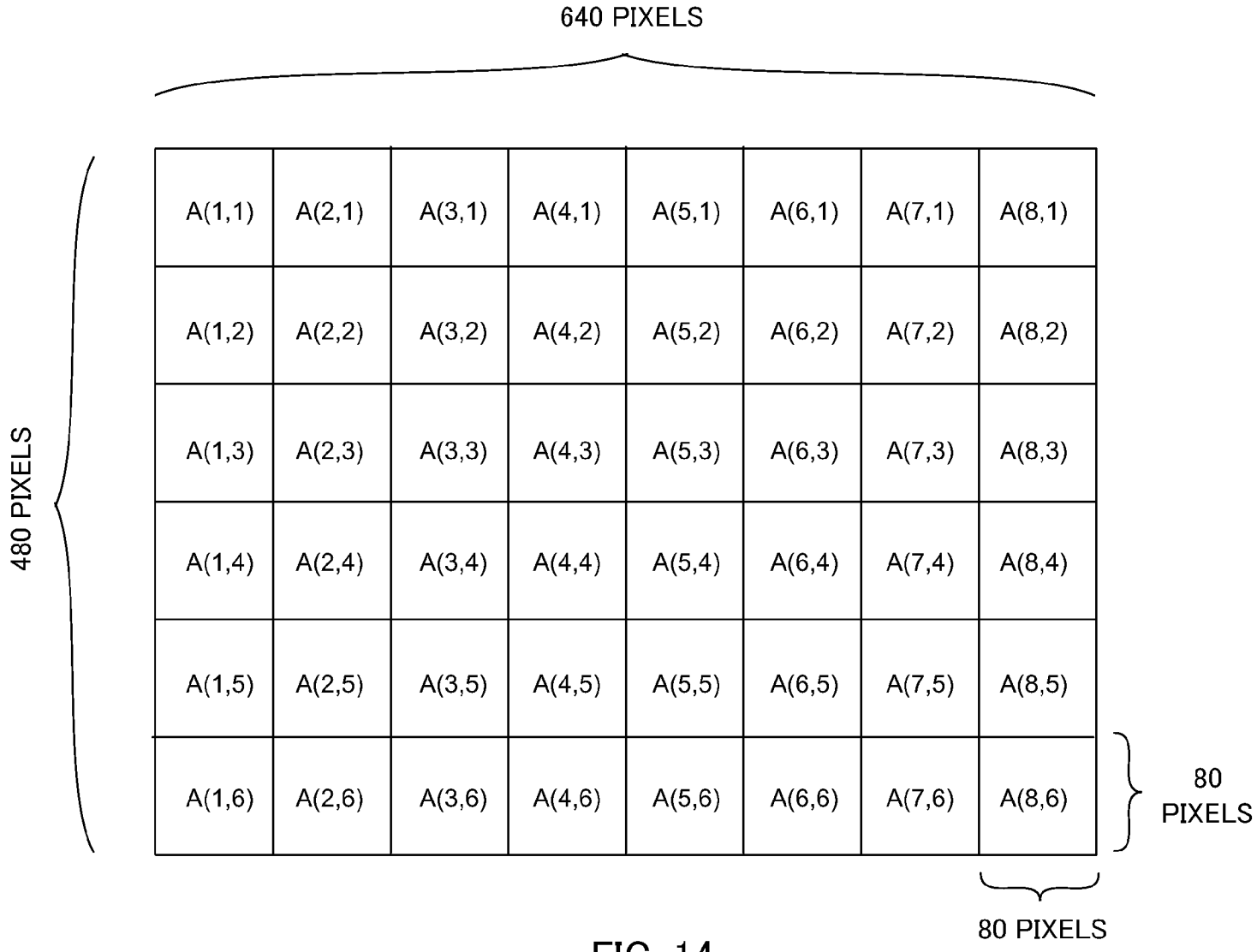
FIG. 14 is a diagram explaining an example of screen segmentation into blocks.

As shown in FIG. 14, a screen composed of 640×480 pixels is divided into 8×6 blocks (A(1, 1)~A(8, 6)). Accordingly, in this example, one block is composed of 80×80=6400 pixels.

Figure 15:
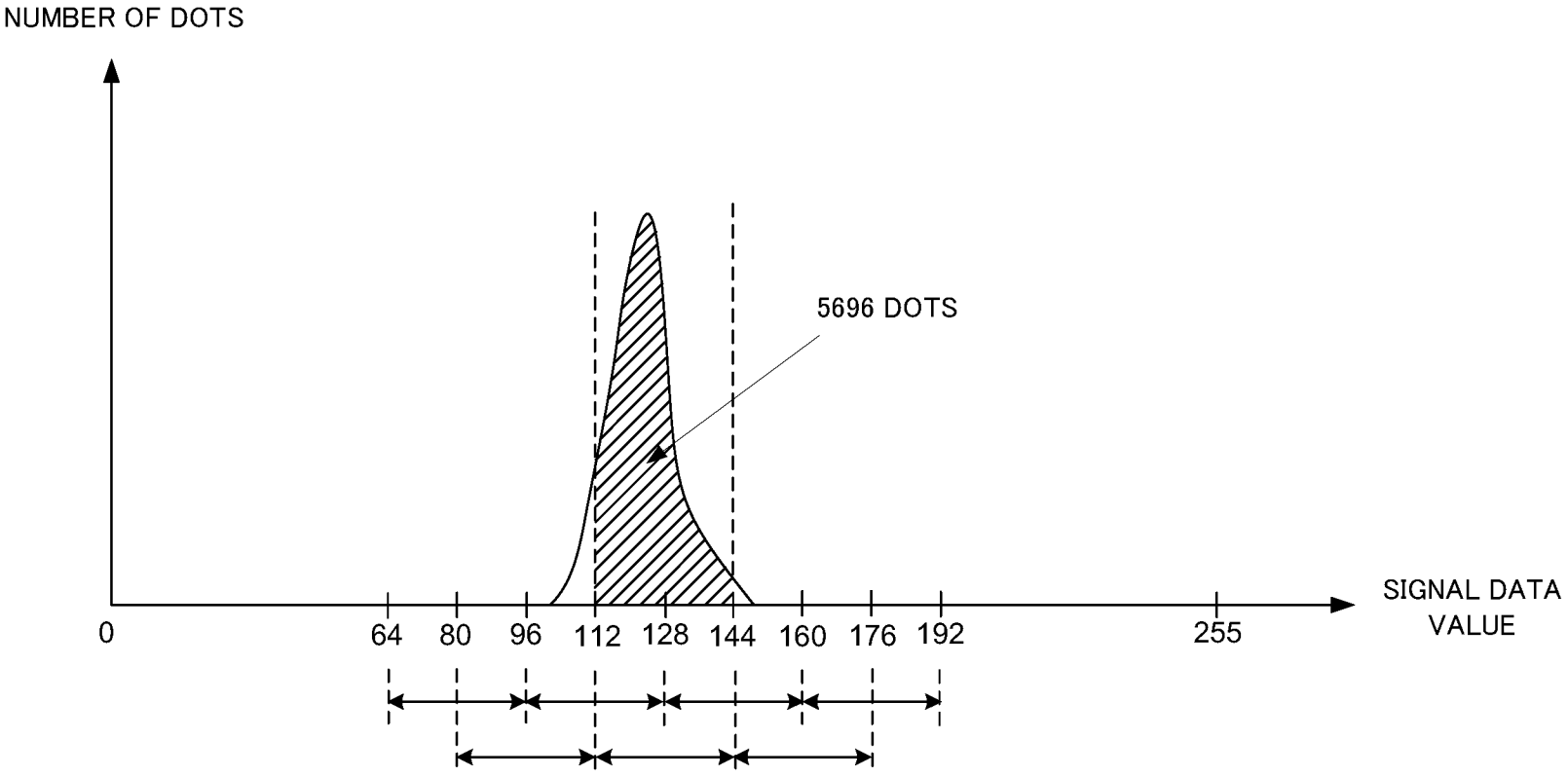
FIG. 15 is a diagram showing an example distribution of signal data values for one block.

When signals denote data having tone levels from 0 to 255, it is checked whether or not 80% or more of the signal data for each block fall within any one of the seven ranges shown in FIG. 15. More specifically, assuming that the signal data value is represented by D, it is determined whether or not signal data for each block satisfy the 80% condition in any one of the seven ranges in this example expressed as $64 \leq D < 96$, $80 \leq D < 112$, $96 \leq D < 128$, $112 \leq D < 144$, $128 \leq D < 160$, $144 \leq D < 176$, and $160 \leq D < 192$.

Here, one block is composed of 80×80=6400 pixels as explained above, and in the example case illustrated in FIG. 15, 5696 dots fall within the signal data value range from 112 to less than 144. As 5696/6400=0.89=89%, it is determined that this block is a uniform intermediate-tone block.

Figure 16:
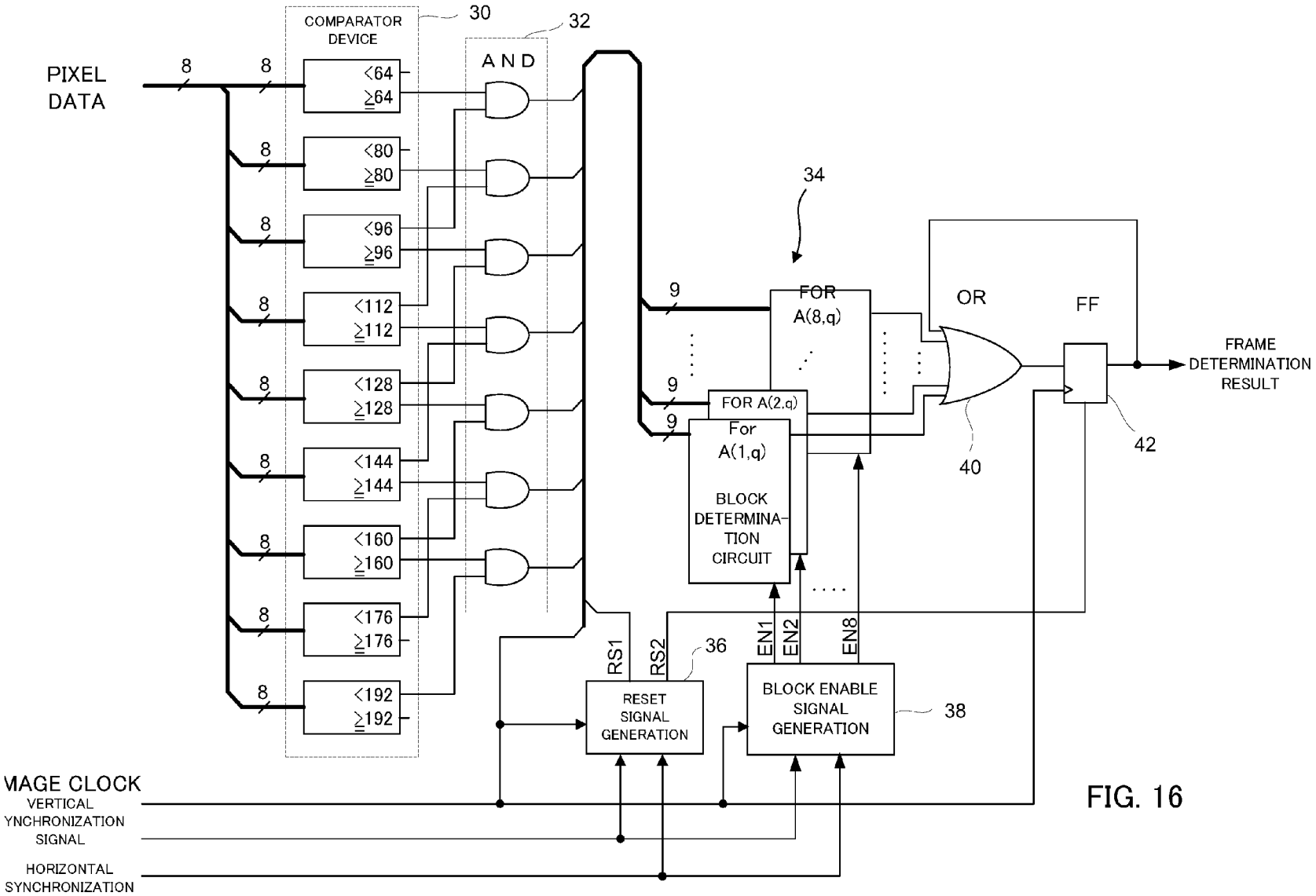
FIG. 16 is a diagram showing an example circuit for determining whether or not a uniform intermediate-tone portion is present.

When it is determined that such a block is present within a frame, the image lag alleviating function is activated. FIG. 16 shows an example circuit for making this determination. An image data is input to a comparator device 30 composed of nine comparators. The nine comparison results are input to an AND circuit 32 composed of seven AND gates. When the image data falls within any one of the above-noted seven ranges, HIGH level is output from the corresponding AND gate of the AND circuit 32.

The seven outputs from the AND circuit 32 are input to a block determination circuit 34 composed of eight block determination circuits provided for the eight block columns. Further, a counter reset signal generation circuit 36 is provided, and this circuit 36 generates a counter reset signal RS1 for every 80 horizontal lines, i.e., for every block row. A block enable signal generation circuit 38 is also provided, and, for every set of pixel data for 80 pixels, this circuit 38 sets a block enable signal ENx (EN1~EN8) of a corresponding block column to HIGH level.

From the eight block determination circuits for block columns, determination results of their corresponding columns are output block row by block row, and these results are supplied to an OR circuit 40. An output from the OR circuit 40 is input to a flip-flop (FF) 42. The flip-flop 42 outputs a determination result for one frame. It should be noted that the block determination circuits for block columns sequentially repeat the determination process for the six block rows. The OR circuit 40 outputs HIGH level when at least one HIGH level is present in the determination results for one block row. Because the output from the flip-flop 42 is provided as feedback to an input terminal of the OR circuit 40, the outputs from the OR circuit 40 and the flip-flop 42 are maintained at HIGH level unless the flip-flop 42 is reset. As the flip-flop 42 is reset by RS2 created from a vertical synchronization signal, the flip-flop 42 is reset once every frame. Further, it should be noted that a pixel clock is input to a clock input terminal of the flip-flop 42.

With the above-described arrangement, a frame determination result that produces HIGH level is obtained as the output from the flip-flop 42 when, in at least one block within one frame, a predetermined number or more of pixels having a signal level within a predetermined range are present (i.e., a uniform intermediate-tone portion is present).

Figure 17:
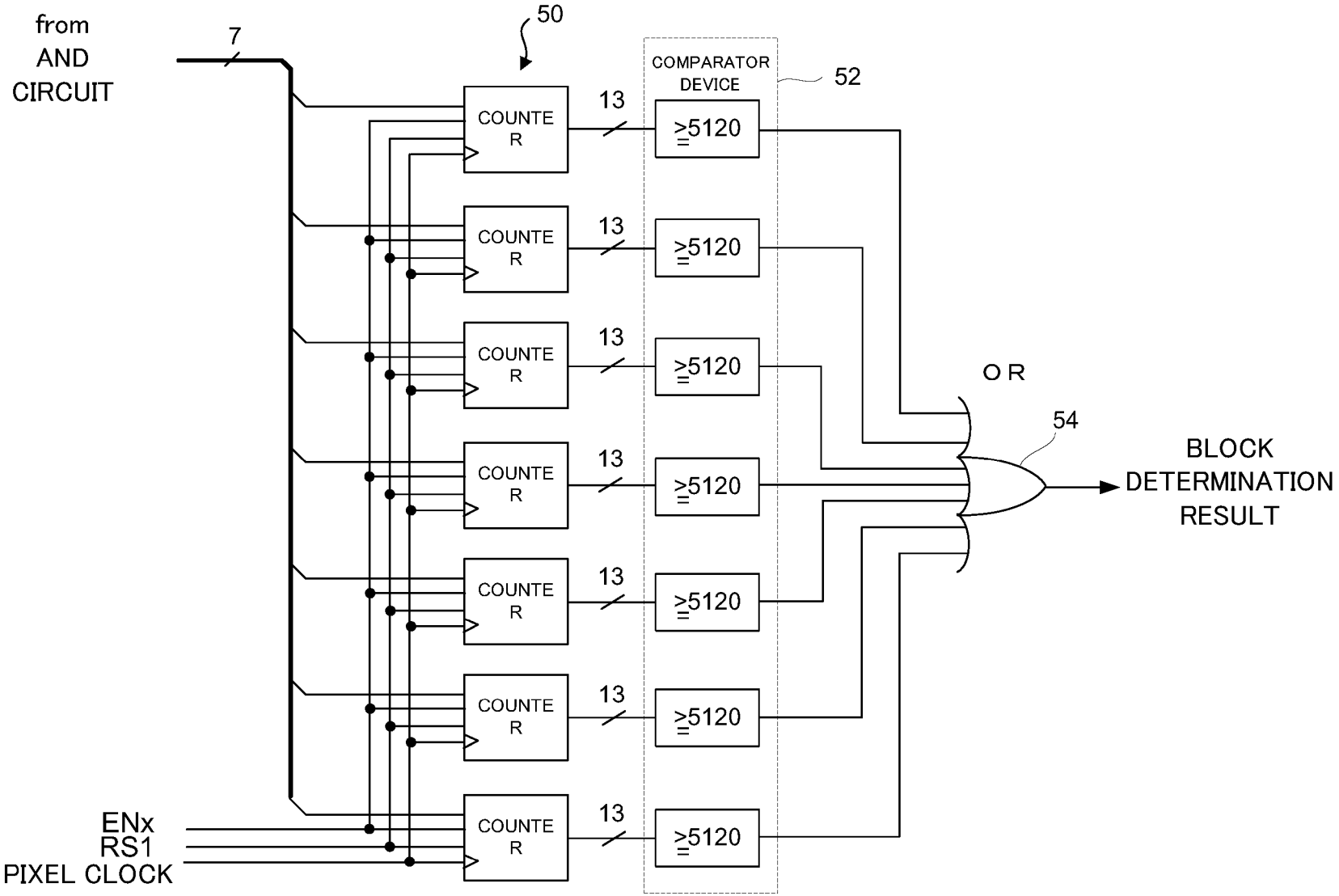
FIG. 17 is a diagram showing an example configuration of a block determination circuit.

FIG. 17 shows a configuration of the block determination circuit 34. The outputs from the AND circuit are input to a counter circuit 50 composed of seven counters.

Each counter is supplied with the enable signal ENx, counter reset signal RS1, and pixel clock. More specifically, while HIGH level is being supplied as the enable signal ENx, HIGH level from the AND circuit 32 is counted up in accordance with the pixel clock. After an elapse of a period for one block row, each counter is reset by the counter reset signal RS1.

Accordingly, the enable signal ENx makes it possible to identify which block column of image data within a horizontal line is being input, and HIGH level of the signals from the AND circuit 32*a* are counted up by the corresponding counters. The outputs from the respective counters of the counter circuit 50 are input to a comparator device 52 composed of seven comparators, so as to determine whether or not each counter output is 5120 or greater. When at least one of these comparators indicates HIGH level, the OR gate 54 outputs HIGH level.

Figure 18:
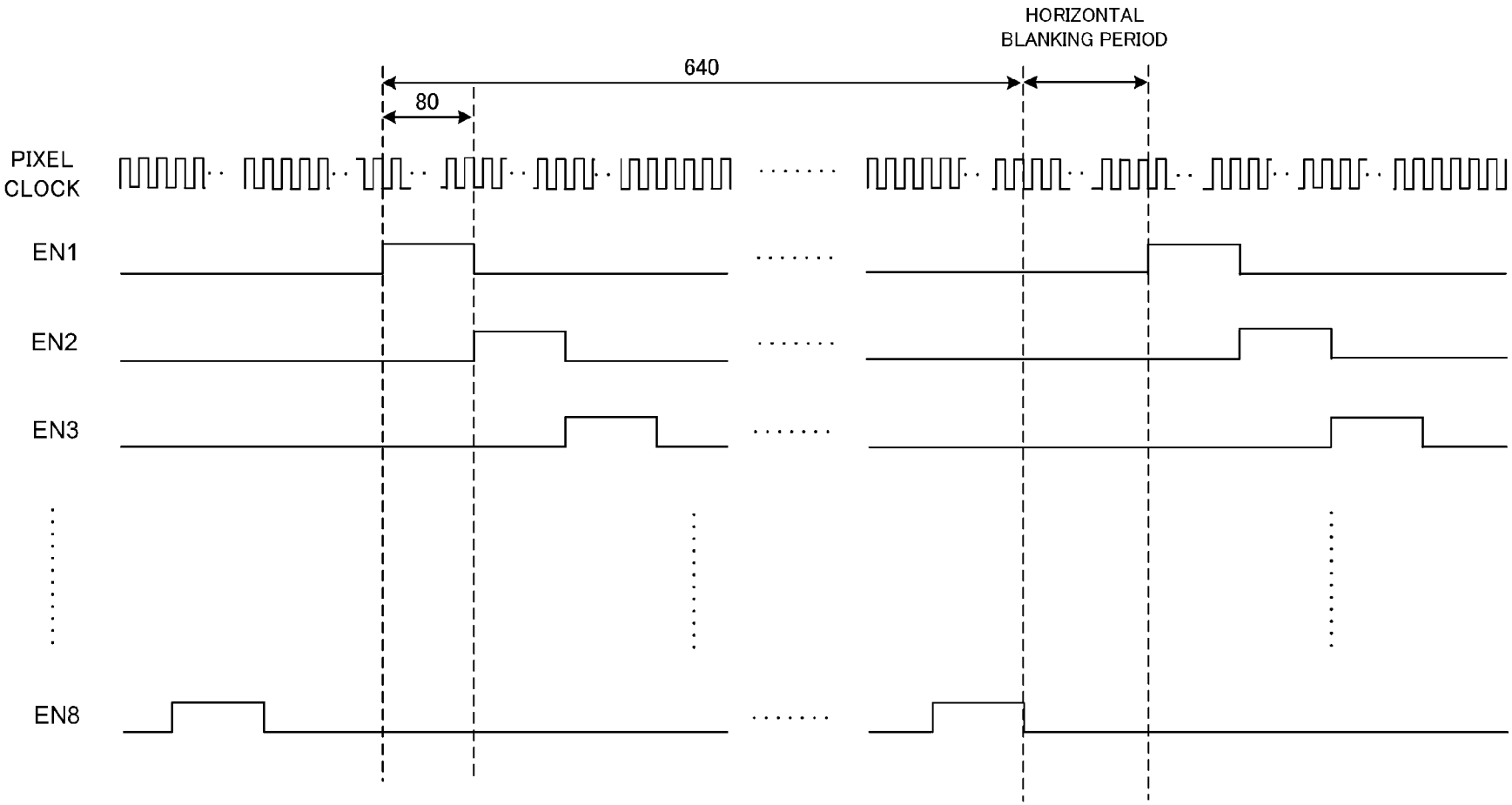
FIG. 18 is a diagram showing an example of signal timings at the respective sections.

As described above, the same block determination circuit is used for the blocks in the same column. The block enable signal ENx (EN1~EN8) is generated so as to be sequentially changed after every 80 pixels within one row at the timings shown in FIG. 18. When the enable signal ENx and the signal from the AND circuit 32 are both HIGH, the counters count up. The counters are initialized by the counter reset signal RS1 after every 80 horizontal lines, i.e., one block row, and subsequently the determination process for the next 80 horizontal lines is started. All of the block determination results obtained in this manner are subjected to the OR operation in the OR circuit shown in FIG. 16 together with the output from the flip-flop 42. When at least one block satisfies the condition, the determination result indicates that the frame includes a uniform intermediate-tone portion.

While seven ranges each having the width of 32 tones are designated, and inclusion of more than 80% of the pixels within one of the ranges is set as the condition to be satisfied in the above example, these values are example values only and should be optimized in accordance with the system to which the invention is applied.

Further, in the above three embodiments of the present invention, when the image lag alleviating function is turned on, the image signal level is increased by multiplying (one frame period/lights-on period within one frame), as compared to when the image lag alleviating function is turned off, in order to keep the average brightness unchanged.

As described above, according to an embodiment of the present invention, the function for alleviating image lag is operated only when the image is changed and for a certain duration from the point of the change. As such, disadvantageous effects due to unnecessary operations of the image lag alleviating function can be minimized.

Effective control of the image lag alleviating function can be achieved by methods such as those described in the following (i)~(iii):

(i) Activating the image lag alleviating function by a control signal supplied from outside that notifies a change in the image.

(ii) Providing means for detecting a motion in the input image, and operating the image lag alleviating function only when a motion is detected.

(iii) Providing means for determining whether or not the image includes a uniform portion having an intermediate tone, and operating the image lag alleviating function only when a uniform intermediate-tone portion is detected. (Here, a determination of the intermediate tone is not always necessary.)

Figure 2:
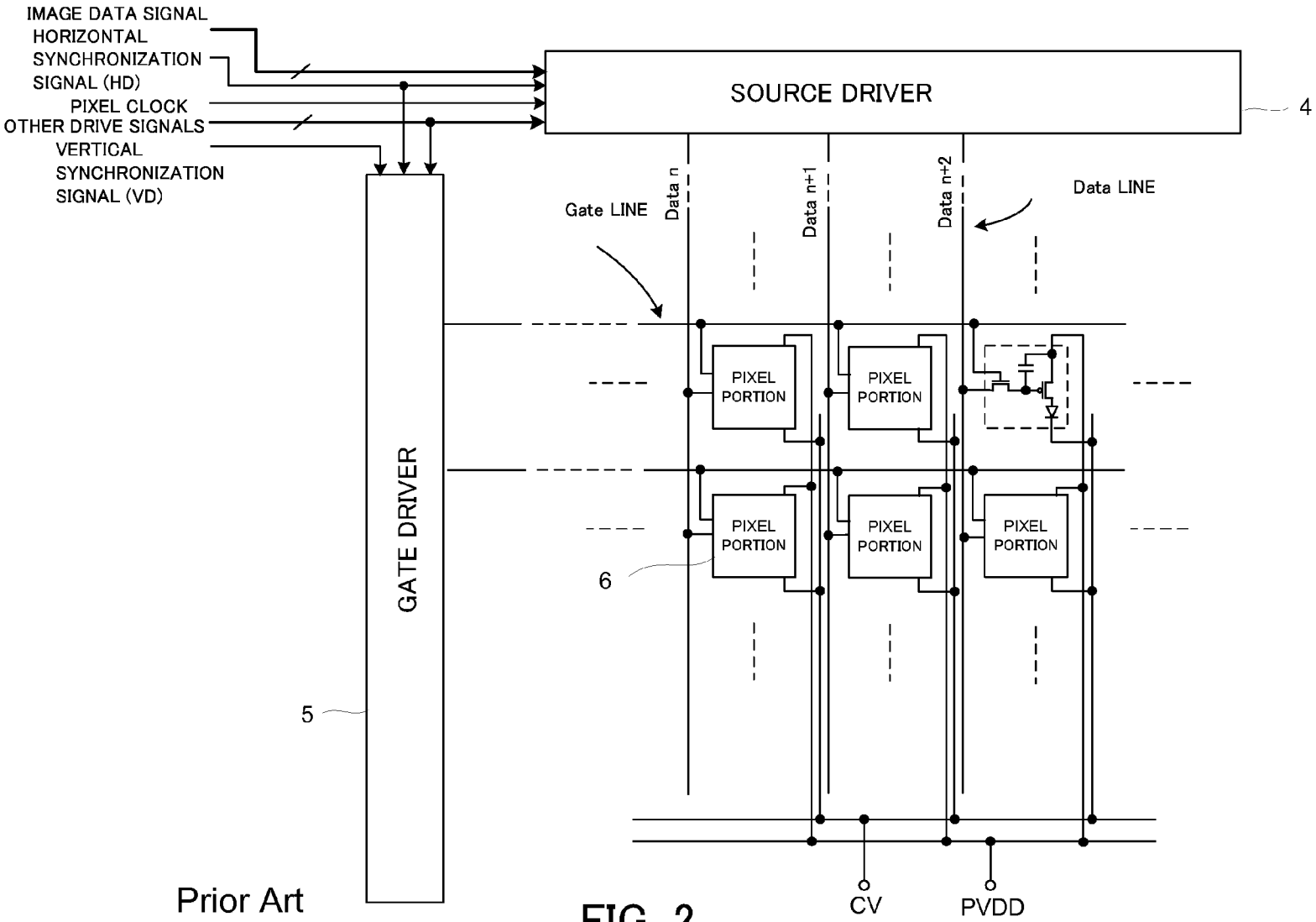
FIG. 2 Prior Art
FIG. 2 is a diagram showing an example configuration of a display panel and input signals.
Figure 3:
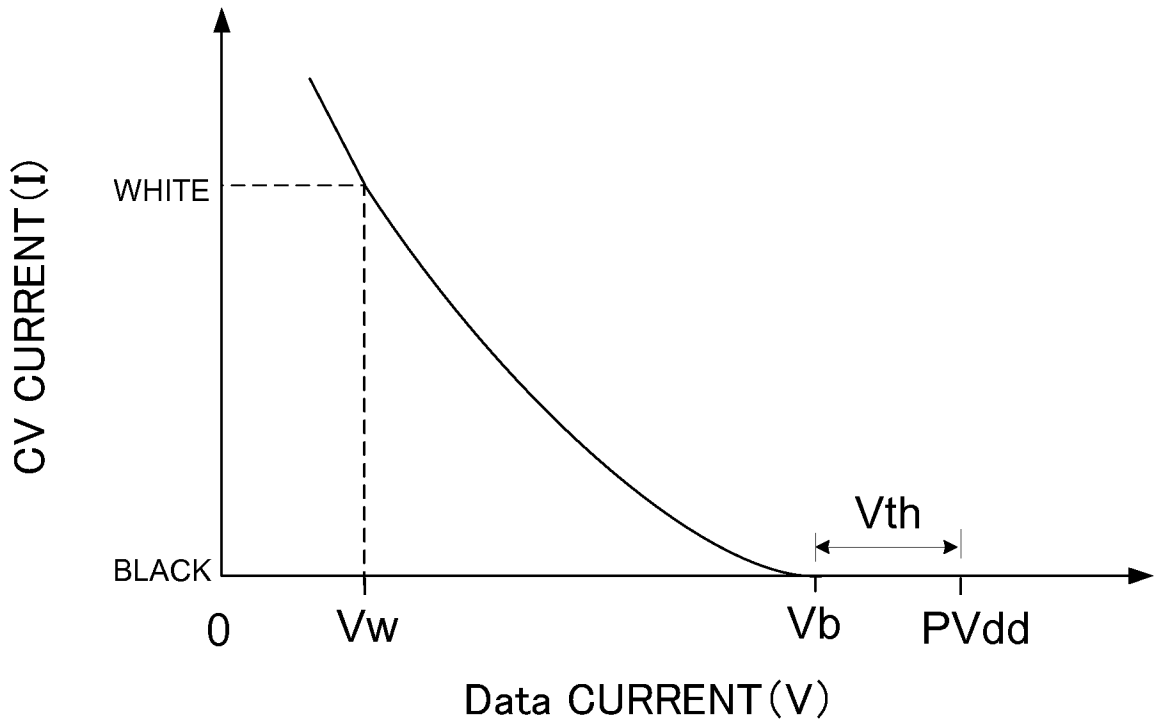
FIG. 3 Prior Art
FIG. 3 is a diagram showing a relationship of a current CV that flows through an organic EL element with respect to an input signal voltage of a drive TFT.
Figure 4:
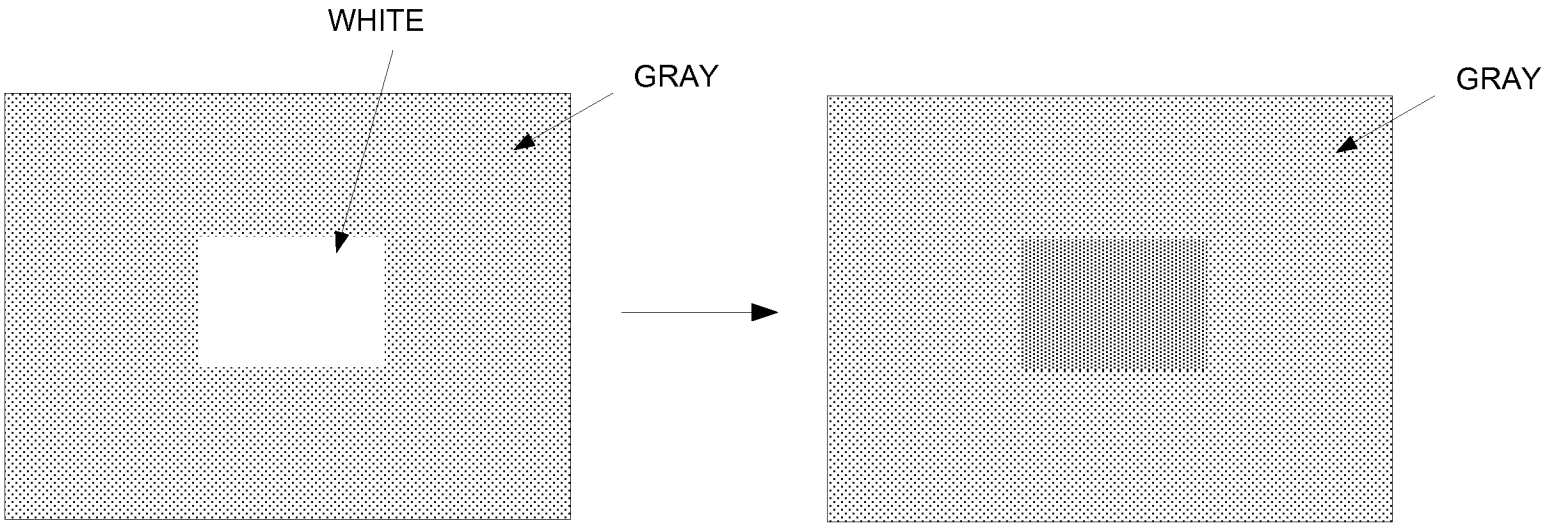
FIG. 4 Prior Art
FIG. 4 is a diagram showing the situation in which a white window pattern was displayed just a moment before on a gray background.
Figure 5:
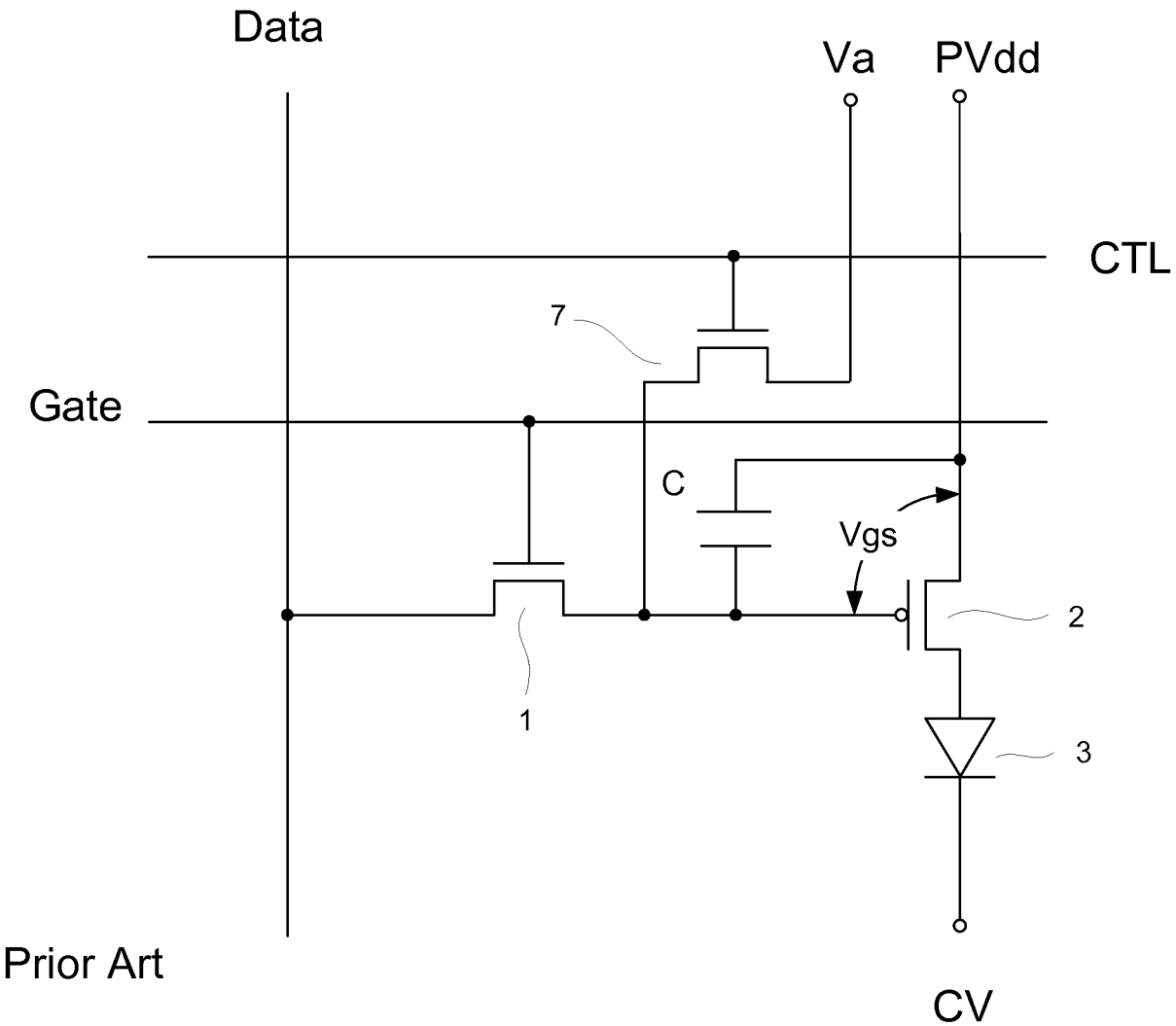
FIG. 5 Prior Art
FIG. 5 is a diagram showing an example configuration of a pixel circuit used when applying an opposite bias voltage to the drive TFT.
Figure 6:
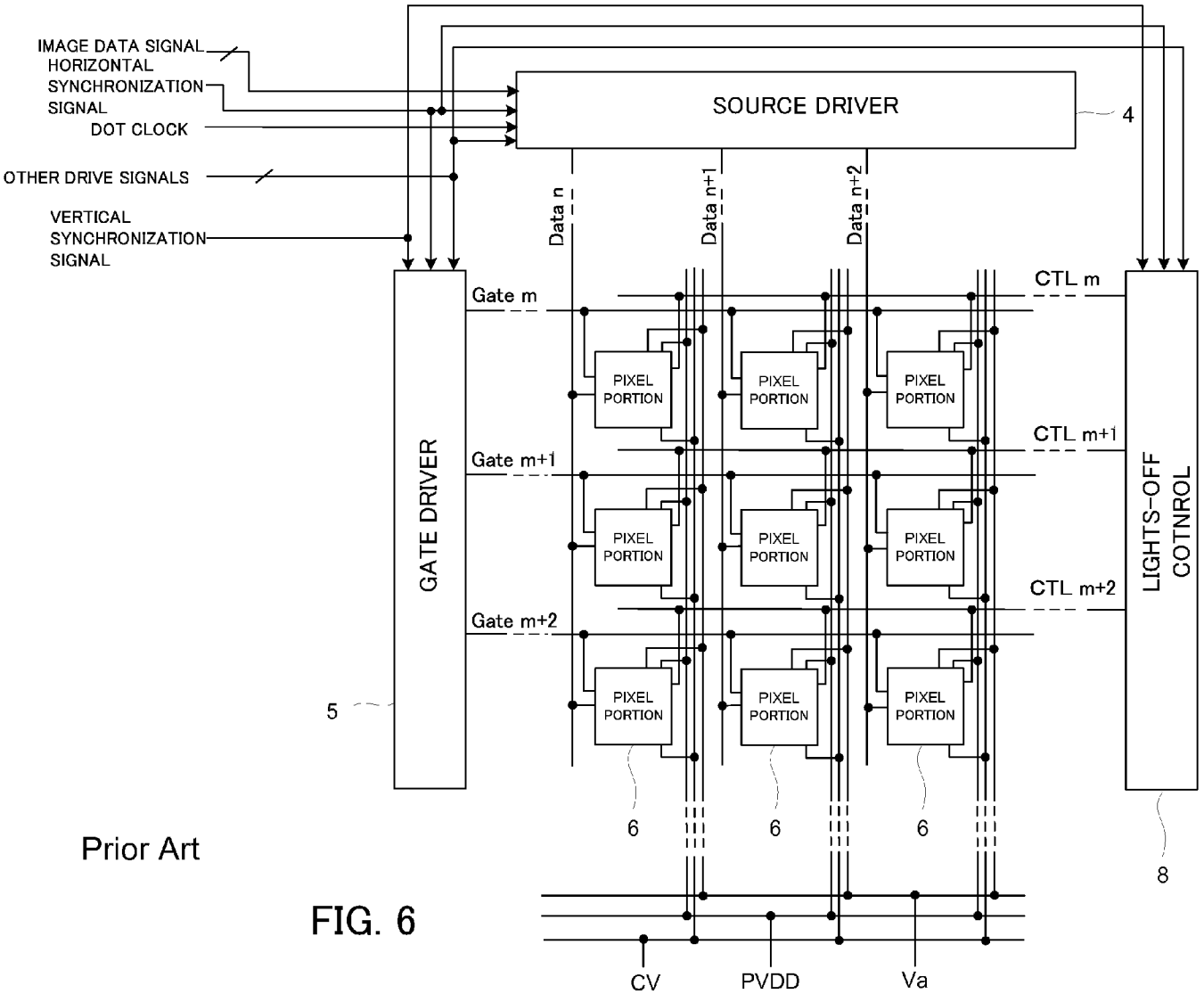
FIG. 6 Prior Art
FIG. 6 is a diagram showing an example configuration of a display panel provided with a lights-off control circuit and input signals.
Figure 7:
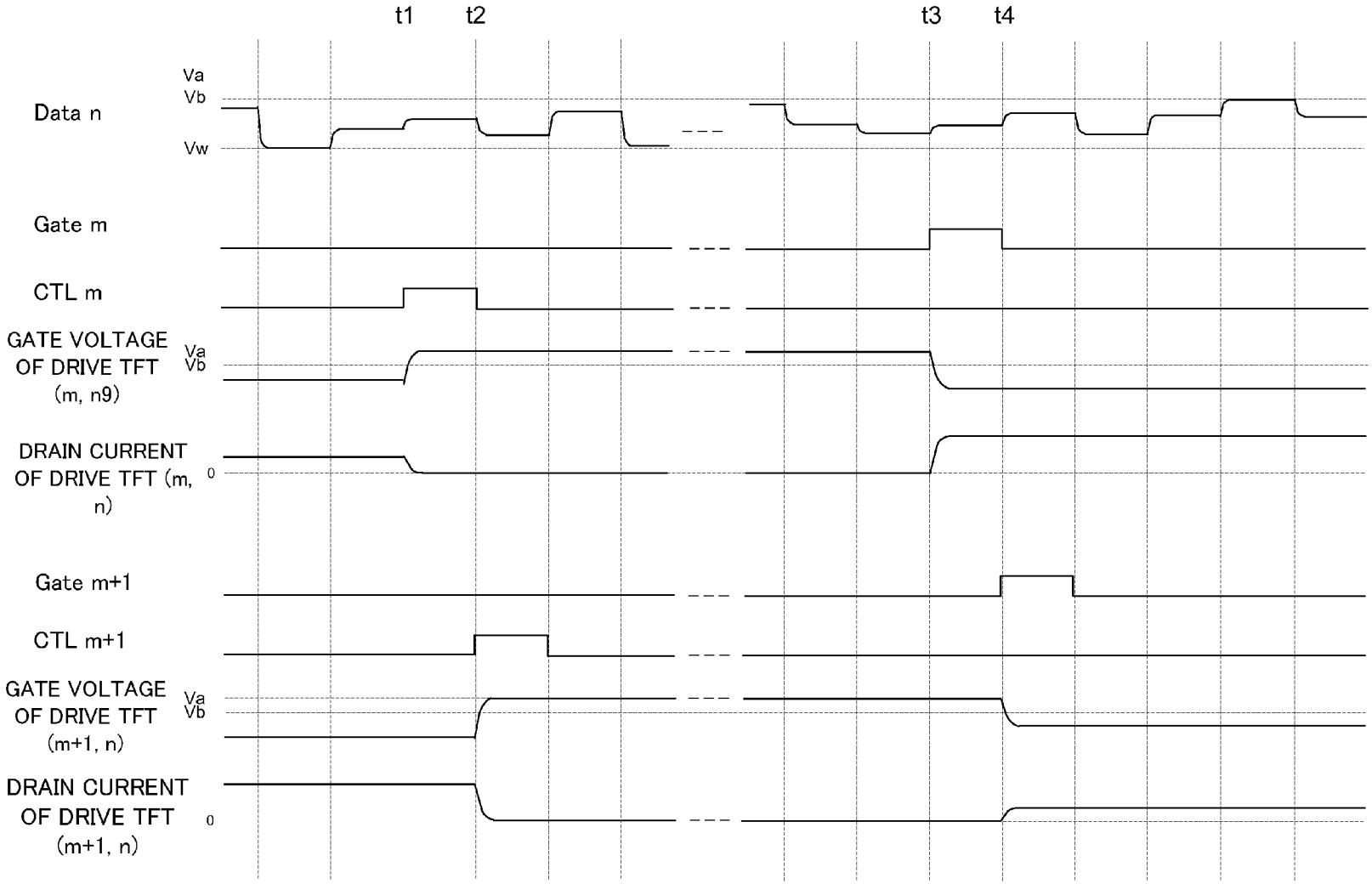
FIG. 7 Prior Art
FIG. 7 is a timing chart showing the states of the drive TFT when lights-off operations are performed.
Figure 8:
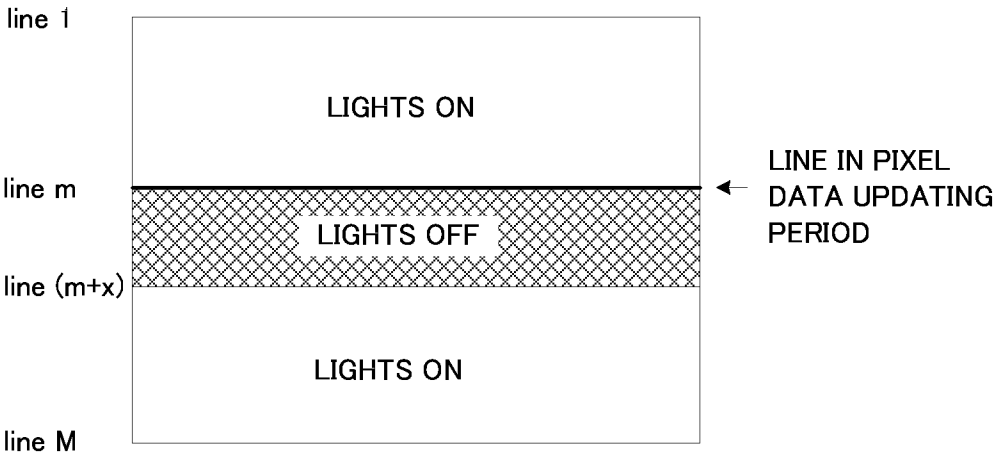
FIG. 8 Prior Art
FIG. 8 is a diagram showing an example display state when lights-off operations are performed.
Figure 19:
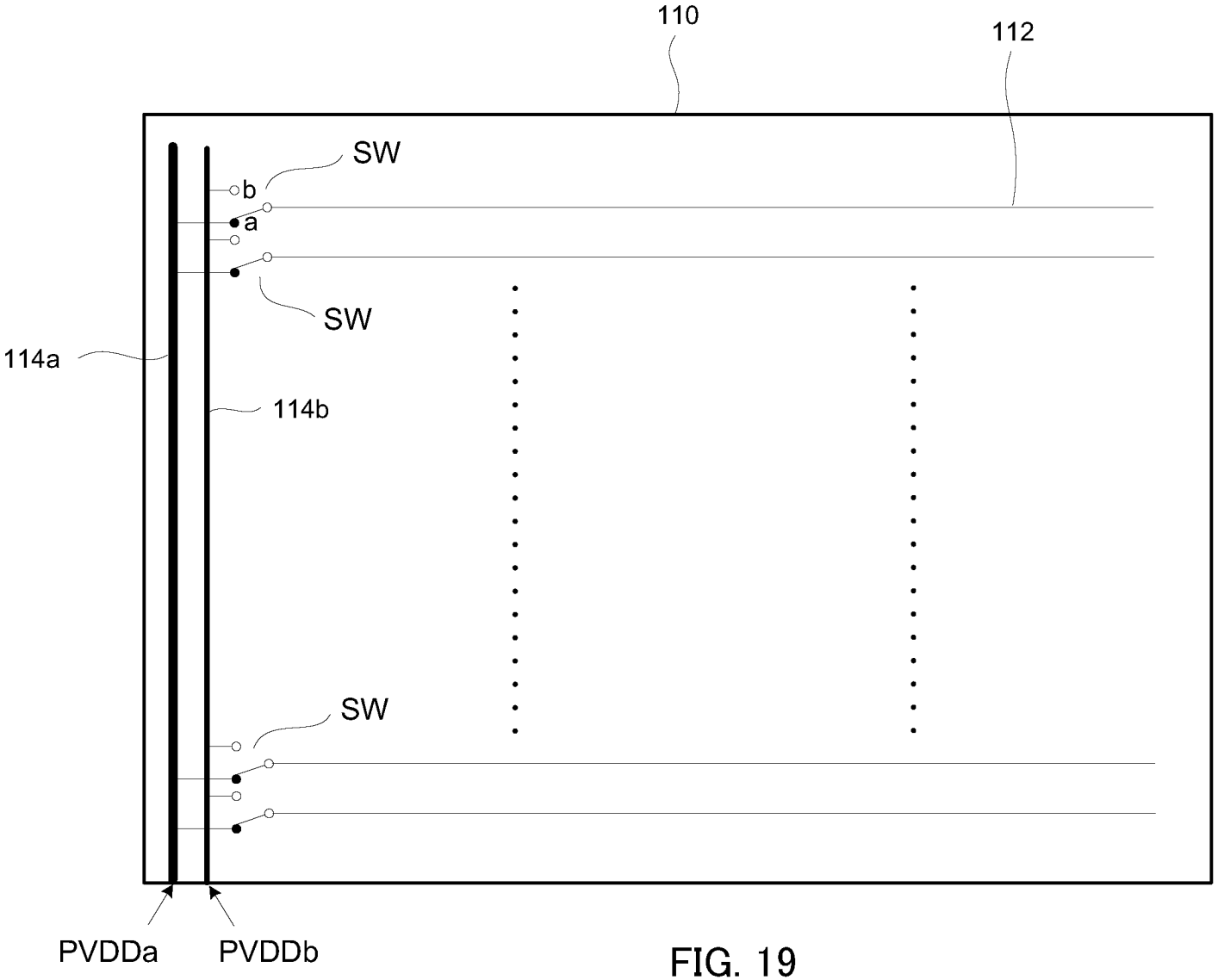
FIG. 19 is a diagram showing an example layout of power supply lines (horizontal and vertical PVDD lines) when switches are provided on one side for each horizontal PVDD line.

Next given below are brief descriptions of other methods for applying an opposite bias voltage to the drive transistor in order to alleviate image lag. FIG. 19 shows an example layout of power supply lines (horizontal and vertical PVDD lines) in a panel in which switches are provided on one side for each horizontal PVDD line. In an organic EL panel 110, pixels are arranged in a matrix as shown in FIG. 2. Further, each horizontal PVDD line 112 is arranged for each row of pixels. On one side of the organic EL panel 110, there are provided two vertical PVDD lines, i.e., a vertical PVDD line 114*a* connected to a power supply PVDDa and a vertical PVDD line 114*b* connected to a power supply PVDDb. Each horizontal PVDD line 112 is configured to be connected to the two vertical PVDD lines 114*a* and 114*b* in an alternately switching manner via a switch SW.

Figure 20:
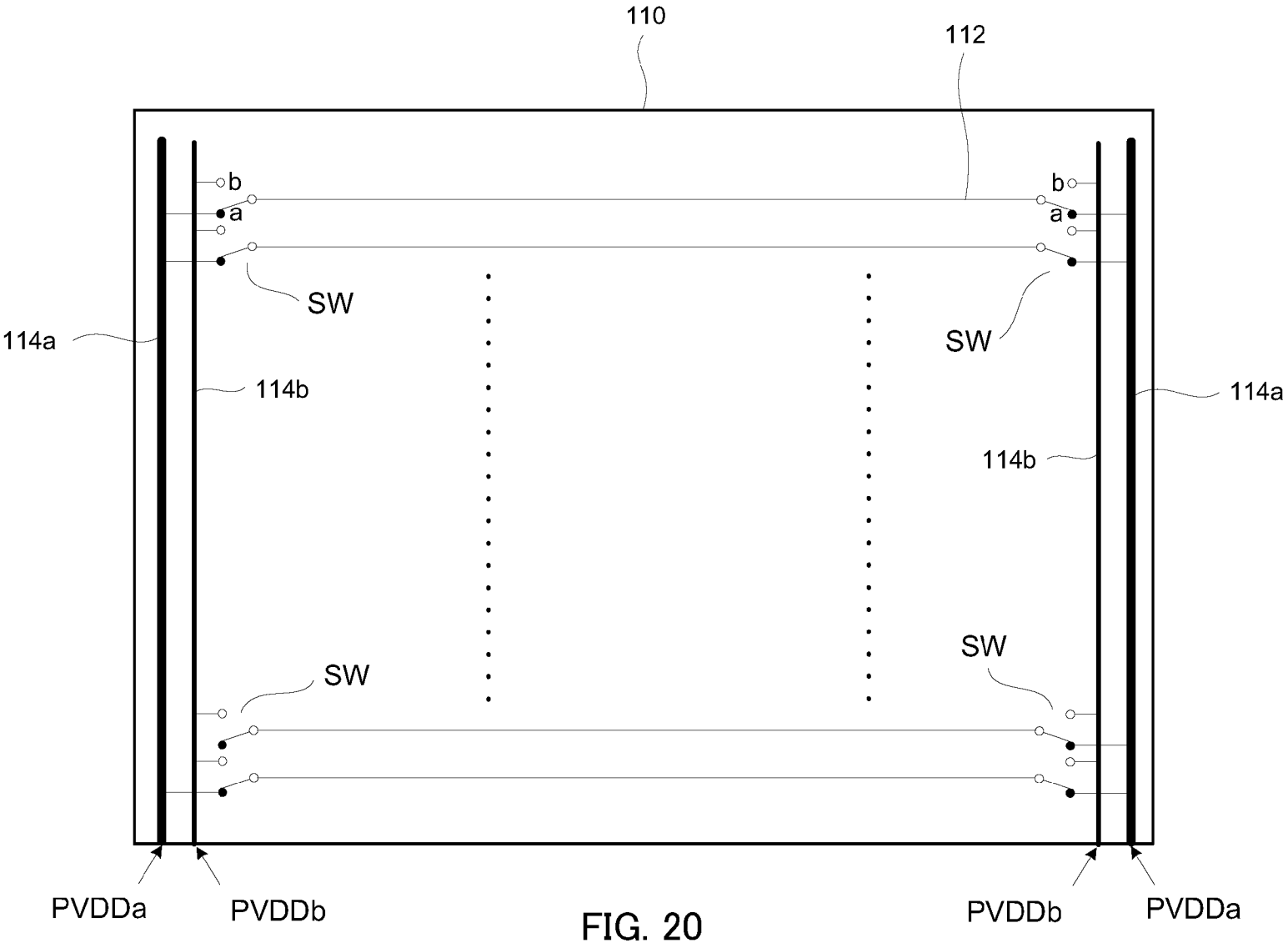
FIG. 20 is a diagram showing an example layout of power supply lines when switches are provided on both sides.

Further, FIG. 20 shows an example layout of power supply lines when switches are provided on both sides. Both the vertical PVDD lines 114*a* and 114*b* are provided on both sides of the organic EL panel 110. Each horizontal PVDD line 112 is connected at both ends to the vertical PVDD lines 114*a* and 114*b* in an alternately switching manner via switches SW. The switches SW provided on the two sides of one horizontal PVDD line 112 are controlled to be connected to the same vertical PVDD lines 114*a* or 114*b*.

Here, PVDDa is the power supply for connection during pixel light emission, while PVDDb is the power supply for connection during application of an opposite bias voltage. Because a relatively large current flows through the vertical PVDD line 114*a*, voltage drop due to resistance is minimized by providing a large line width and the like. On the other hand, because almost no current flows through the vertical PVDD line 114*b*, its line width may be narrow. By providing switches on both sides as shown in FIG. 20, it is possible to minimize voltage drop due to resistance in the wiring from the PVDDa terminal, which provides connection with the vertical PVDD line 114*a* and the power supply, to the pixel.

Figure 21:
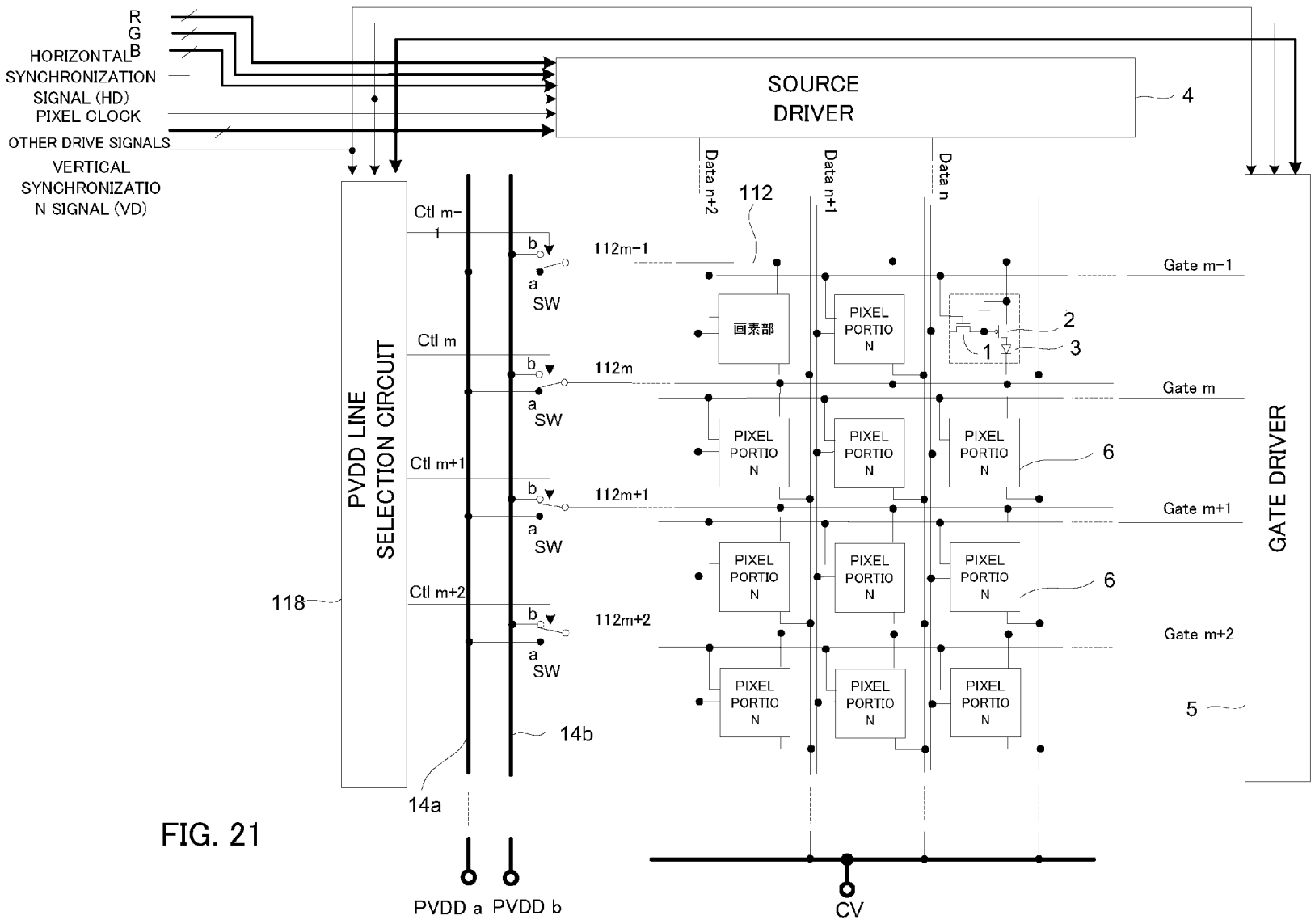
FIG. 21 is a diagram showing an example configuration of a panel when switches are provided on one side for each horizontal PVDD line.

FIG. 21 shows an example panel configuration corresponding to FIG. 19 where switches are provided on one side for each horizontal PVDD line 112, and illustrates a configuration for pixels 6 arranged in four rows×three columns (rows m−1~m+2, columns n~n+2). As shown, a PVDD line selection circuit 118 is provided, which controls switching of the switches SW. The lines extending from the horizontal PVDD line selection circuit 118 for the control of the switches SW are labeled lines Ctl m−1~Ctl m+2.

Figure 22:
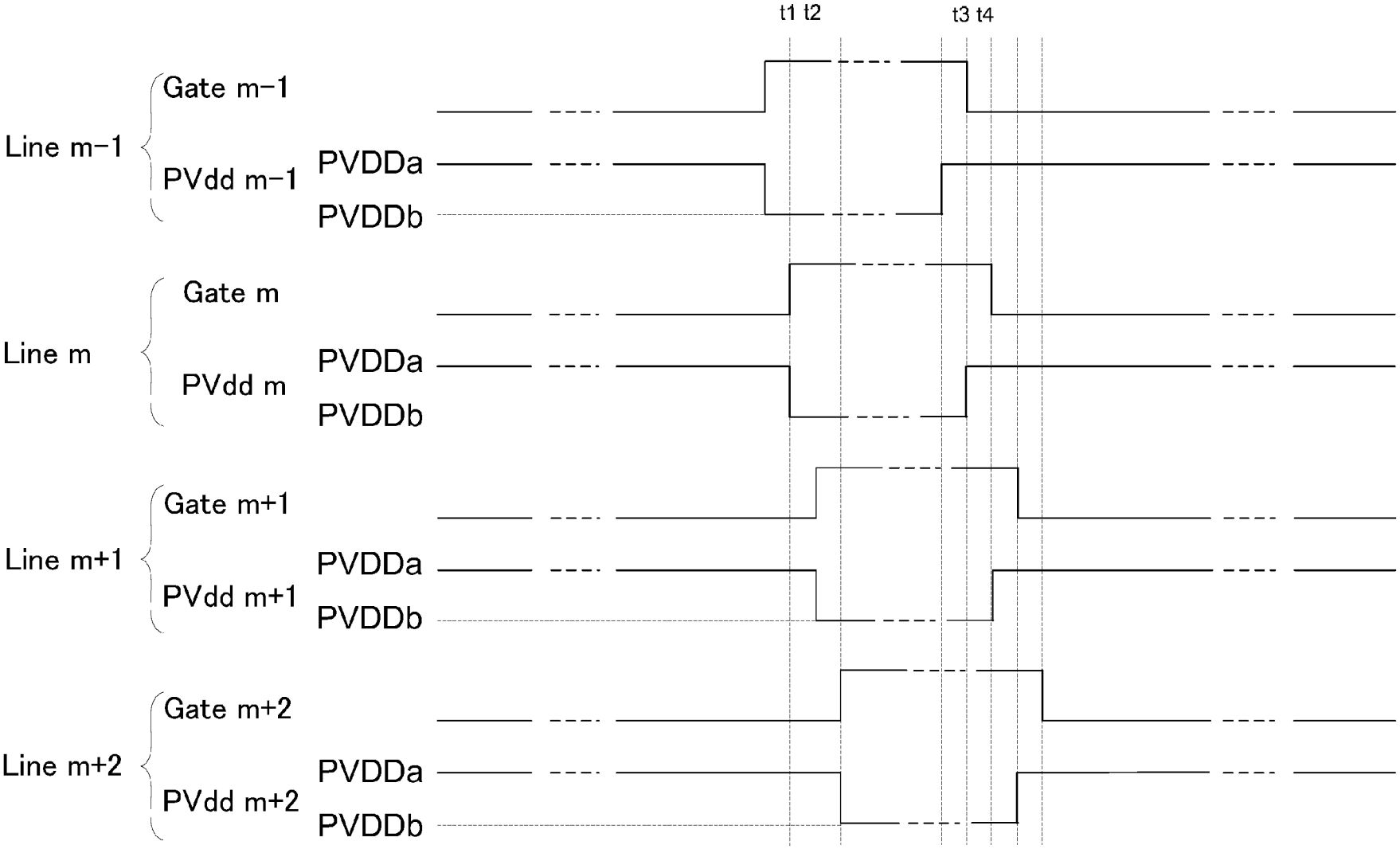
FIG. 22 is a diagram showing changes in the voltages of the horizontal PVDD lines and the timings of the gate lines.

FIG. 22 shows the changes in the voltages of the horizontal PVDD lines 112 and the timings of the gate lines Gate. During light emission and data writing, in order to cause power to be supplied to the horizontal PVDD line 112 of a certain row (Line) from the vertical PVDD line 114*a* (PVDDa), the switch SW is switched to the "a" side. Referring to Line m, SW is controlled such that, during the period t1-t3, power is supplied from the vertical PVDD line 114*b* (PVDDb). During this period, the gate line Gate is set to HIGH so as to turn on the selection TFT. As a result, although the drive TFT is placed in the state of being applied with a data voltage for writing into a pixel of a different horizontal line, by setting PVDDb to a voltage lower than the minimum voltage of the writing voltage, i.e., a voltage lower than the minimum output voltage of the source driver 4, the drive TFT is unfailingly applied with an opposite bias voltage and the pixel is turned off. The writing of the data voltage is performed during the period t3-t4, during which Gate m is set to HIGH and the voltage of PVDDm is PVDDa. Light emission is maintained until Gate m is again set to HIGH after t4, in the subsequent frame.

The invention claimed is:

1. An active matrix type display device in which a current-driven emissive element is provided in each of a plurality of pixels arranged in a matrix, and a current of the emissive element is controlled using a drive TFT so as to perform sequential display of a plurality of images having a predetermined frame period, the display device comprising:

an image lag alleviating function that, when turned on, applies an opposite bias voltage between a gate electrode and a source electrode of the drive TFT;

a first detector for detecting whether or not a first image of the plurality of images includes a uniform portion having an intermediate tone;

a second detector for detecting motion of the first image from a previous image of the plurality of images; and a microcomputer to turn on the image lag alleviating function for a preset time when the first detector detects that the first image of the plurality of images includes a uniform portion having an intermediate tone and the second detector detects motion of the first image from a previous image of the plurality of images, wherein when the image lag alleviating function is turned on, a signal level of the first image is increased by multiplying the signal when the image lag alleviating function is turned off by a ratio of (one frame period/lights-on period within one frame period).

2. The display device of claim 1, the display device comprising a digital photo frame and the frame period is several seconds to several tens of seconds.

3. The display device of claim 1, wherein one or more of the plurality of images comprise a menu screen.

4. The display device of claim 3, wherein one or more of the plurality of images comprise icons with high brightness portions displayed on a background of intermediate tone.

* * * * *